US009623293B2

(12) United States Patent
Abe

(10) Patent No.: US 9,623,293 B2
(45) Date of Patent: Apr. 18, 2017

(54) GOLF CLUB HEAD AND METHOD FOR MANUFACTURING SAME

(71) Applicant: Dunlop Sports Co. Ltd., Kobe-shi, Hyogo (JP)

(72) Inventor: Hiroshi Abe, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 238 days.

(21) Appl. No.: 14/453,737

(22) Filed: Aug. 7, 2014

(65) Prior Publication Data

US 2015/0045144 A1 Feb. 12, 2015

(30) Foreign Application Priority Data

Aug. 8, 2013 (JP) ..... 2013-165483

(51) Int. Cl.

*A63B 53/04* (2015.01)
*B21D 53/00* (2006.01)
*A63B 60/52* (2015.01)

(52) U.S. Cl.

CPC ..... *A63B 53/04* (2013.01); *A63B 53/0466* (2013.01); *A63B 60/52* (2015.10); *B21D 53/00* (2013.01); *A63B 2053/0408* (2013.01); *A63B 2053/0412* (2013.01); *A63B 2053/0433* (2013.01); *A63B 2053/0458* (2013.01); *A63B 2053/0462* (2013.01); *Y10T 29/49826* (2015.01)

(58) Field of Classification Search

CPC ..... A63B 53/0466; A63B 2053/0458; A63B 2053/0408; A63B 2053/0462; A63B 53/04
USPC ..... 473/342, 350, 345, 329, 330
See application file for complete search history.

(56) References Cited

U.S. PATENT DOCUMENTS 6,348,013 B1 * 2/2002 Kosmatka ..... A63B 53/04 473/329
7,614,964 B2 * 11/2009 Matsunaga ..... A63B 53/0466 473/342
9,017,187 B2 * 4/2015 Abe ..... A63B 53/0466 473/329
2009/0275425 A1 11/2009 Hirano

FOREIGN PATENT DOCUMENTS

JP 2009-285452 A 12/2009

* cited by examiner

*Primary Examiner* — Benjamin Layno
(74) *Attorney, Agent, or Firm* — Birch, Stewart, Kolasch & Birch, LLP

(57) ABSTRACT

A golf club head has a hollow therein and a head volume of not less than 100 cc and less than 350 cc. The head comprises a head main body and a substantially cup-shaped face member which are united with each other. The face member integrally includes a face portion having a club face for hitting a ball, and a turnback extending backwardly of the head from a peripheral edge of the club face. The inner surface of the face member is provided with a groove extending along the boundary of the turnback with the face portion. The face member is a press-formed part whose turnback is bent by press working.

5 Claims, 12 Drawing Sheets

E1 Cross section

GOLF CLUB HEAD AND METHOD FOR MANUFACTURING SAME

BACKGROUND OF THE INVENTION

The present invention relates to a golf club head excellent in the rebound performance and a method for manufacturing the same excellent in the production efficiency.

Japanese Patent Application Publication No. 2009-285452 discloses a method for manufacturing a hollow golf club head. This manufacturing method includes a process for manufacturing a cup-shaped face member defining a face portion of the head and provided with a turnback. This manufacturing process includes a step of cutting and thinning the entirety of a portion corresponding to the turnback, of a flat-plate-like part for the face member, and a step of forming the turnback by press working.

SUMMARY OF THE INVENTION

In general, a golf club head having a cup-shaped face member has a tendency that the rebound performance is improved with the increase in the dimension of the turnback measured in the front-back direction of the club head.

On the other hand, when a turnback is to be provided for a flat-plate-like part by press working, it becomes difficult to bend it as the dimension of the turnback increases, therefore, there is a problem with the production efficiency.

It is therefore, an object of the present invention to provide a golf club head and a method for manufacturing the same, in which the production efficiency can be improved even if the turnback has a larger dimension in the front-back direction.

According to the present invention, a golf club head has a hollow therein and a head volume of not less than 100 cc and less than 350 cc, and the head comprises a head main body and a substantially cup-shaped face member which are united with each other, wherein the face member integrally includes a face portion having a club face for hitting a ball, and a turnback extending backwardly of the head from the peripheral edge of the club face, an inner surface on the hollow side, of the face member is provided with a groove extending along the boundary of the turnback with the face portion, and the face member is a press-formed part whose turnback is bent by press working.

The golf club head according to the present invention may have the following features (1)-(6):

(1) the above-mentioned groove is a sole-side groove extending along only a sole-side part of the boundary;

(2) the sole-side groove extends at least 5 mm toward the toe and toward the heel of the head from a position in the toe-heel direction corresponding to that of the sweet spot of the club face;

(3) the face portion is provided with a first section formed in a central part of the face portion and having a constant thickness, a second section formed outside the first section and having a constant thickness smaller than that of the first section, and a transitional section extending annularly around the first section and having a variable thickness decreasing gradually from the first section towards the second section, on the crown-side of the first section, the transitional section extends to said boundary so that the intersection therebetween is positioned on the heel side of the sweet spot, on the sole-side of the first section, the transitional section extends to said boundary so that the intersection therebetween is positioned on the toe side of the sweet spot, the part of the face portion on the toe side of the transitional section and the part of the face portion on the heel side of the transitional section constitute said second section, and said sole-side groove has a toe-side end positioned within the extent of said intersection on the sole-side of the first section;

(4) the sole-side groove extends in the toe-heel direction of the head by at least 5 mm toward the toe and toward the heel of the head from the sweet spot of the club face, and the distance in the toe-heel direction between the sweet spot and the heel-side end of the club face is larger than the distance in the toe-heel direction between the sweet spot and the toe-side end of the club face;

(5) the sole-side groove extends in the toe-heel direction of the head by at least 5 mm toward the toe and toward the heel of the head from the sweet spot of the club face, and the sole-side groove has a heel-side end and a toe-side end such that the distance in the toe-heel direction between the sweet spot and the heel-side end of the sole-side groove is larger than the distance in the toe-heel direction between the sweet spot and the toe-side end of the sole-side groove.

(6) the thickness of the face member measured at the groove is 0.5 to 2.0 mm.

According to the present invention, a method for manufacturing a golf club head having a hollow therein and a head volume of not less than 100 cc and less than 350 cc, comprises a process of connecting a substantially cup-shaped face member and a head main body with each other, wherein the face member integrally includes a face portion having a club face for hitting a ball, and a turnback extending backwardly of the head from the peripheral edge of the club face, and a process of producing the face member which includes the steps of (a) preparing a flat-plate-like plate material, (b) cutting out a flat-plate-like part for the face member from the flat-plate-like plate material, (c) providing the turnback for the flat-plate-like part by press working thereon after the step (b), to form the face member, and (d) forming a groove on the flat-plate-like part or the flat-plate-like plate material prior to the step (c) so that the groove extends along a line corresponding to the boundary of the turnback with the face portion.

The method for manufacturing a golf club head according to the present invention may have the following features (i)-(iii):

(i) the width of the groove is 1.0 to 4.0 mm;

(ii) in the step (c), the flat-plate-like part is bent along the groove to form the turnback;

(iii) in the step (d), the groove is formed so as to extend along only a sole-side part of the boundary.

Therefore, although the face member is a press-formed part in which the turnback is bent during press working, the turnback can be easily bent along the groove due to the relatively small thickness of the grooved part, therefore, the production efficiency of the head especially of the cup-shaped face member can be improved.

Further, such groove facilitates the deflection of the face portion when hit by a golf ball, therefore, the golf club head according to the present invention can be improved in the rebound performance.

In this application including the description and claims, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle alpha while keeping the axis on a vertical plane, and the face forms the specified loft angle (real loft angle) with respect to the horizontal plane HP. Incidentally, in the case of the club head alone, the center line of the shaft inserting hole can be used instead of the axis of the club shaft.

"Front-back direction" is a direction parallel with a straight line projected on the horizontal plane HP, wherein the straight line is drawn normally to the club face passing through the center of gravity G of the club head.

"Toe-heel direction" is a direction parallel with the horizontal plane HP and perpendicular to the front-back direction.

"Sweet spot SS" is the point of intersection between the club face and a straight line drawn normally to the club face passing the center of gravity G of the club head.

The peripheral edge of the club face 2 can be defined by a ridge line if it is readily identifiable. However, if the peripheral edge of the club face 2 is unclear due to smooth change in the curvature, a virtual ridge line which is defined, based on the curvature change is used instead as follows. As shown in FIG. 4(A), in each cutting plane E1, E2 - - - including a straight line extending between the sweet spot SS and the center of gravity G of the head, as shown in FIG. 4(B), a point at which the radius (r) of curvature of the profile line Lf of the face portion first becomes under 200 mm in the course from the center (SS) to the periphery of the club face is determined. Then, the virtual ridge line is defined as a locus of such points.

DESCRIPTION OF THE PREFERRED EMBODIMENTS

A golf club head as an embodiment of present invention will now be described in detail together with a method for manufacturing the same in conjunction with accompanying drawings.

Figure 1:
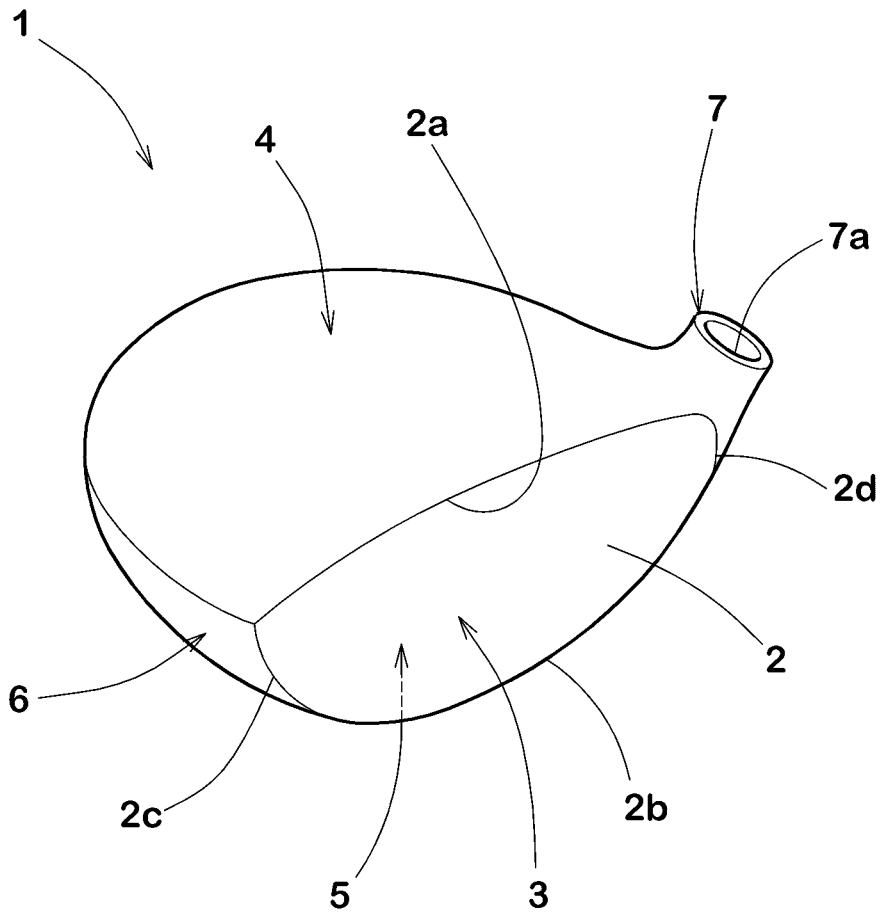
FIG. 1 is a perspective view of a golf club head manufactured by a method as an embodiment of the present invention.
Figure 2:
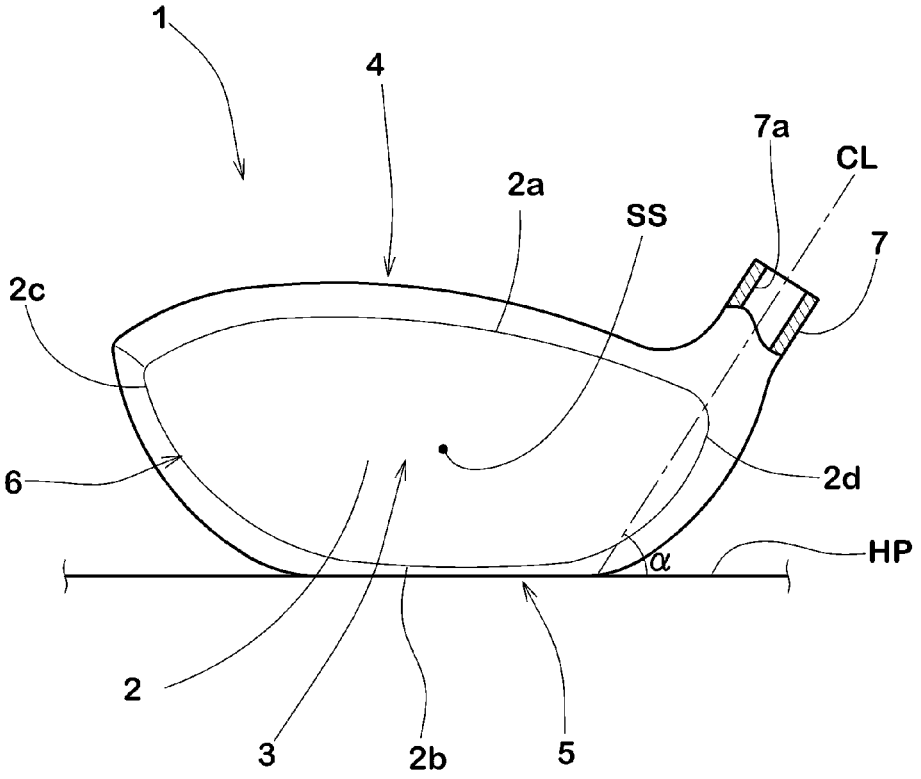
FIG. 2 is a front view of the golf club head in its standard state.
Figure 3:
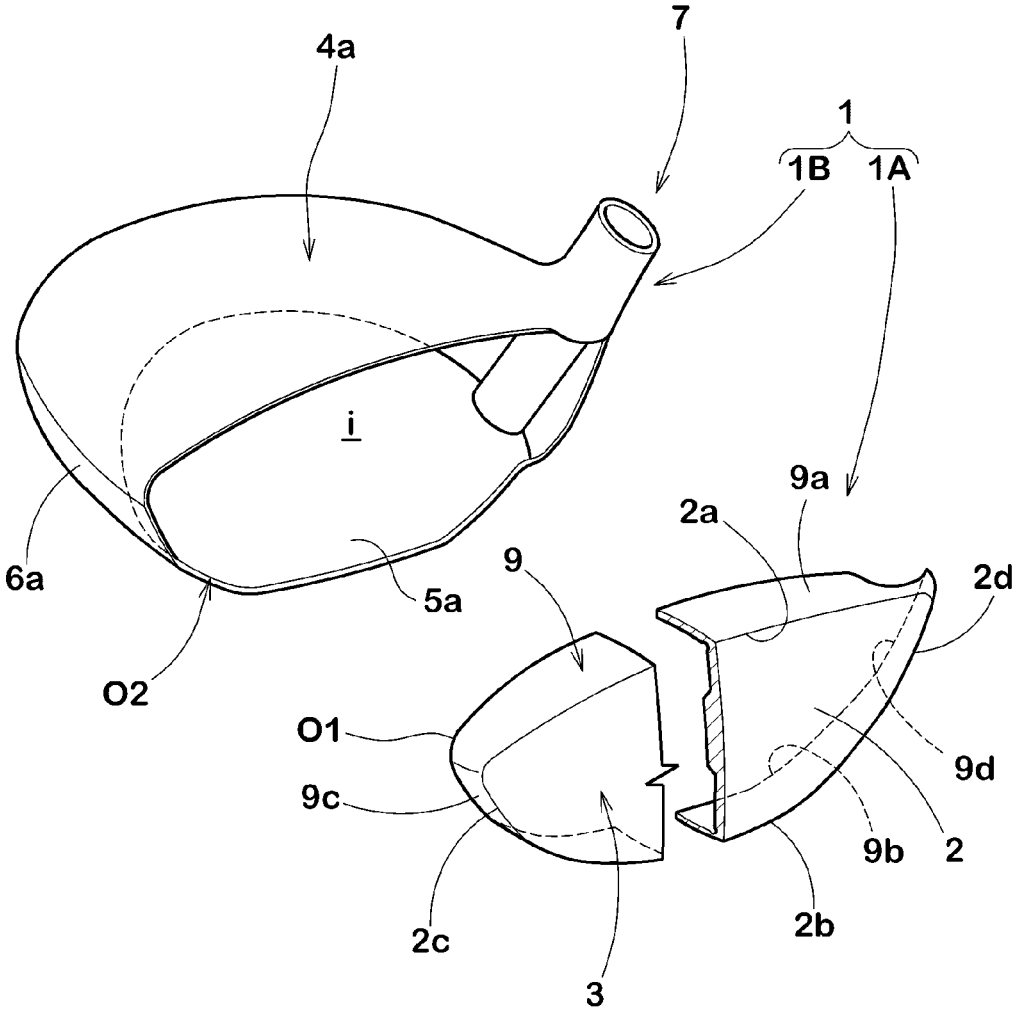
FIG. 3 is an exploded perspective view thereof.
Figure 4A:
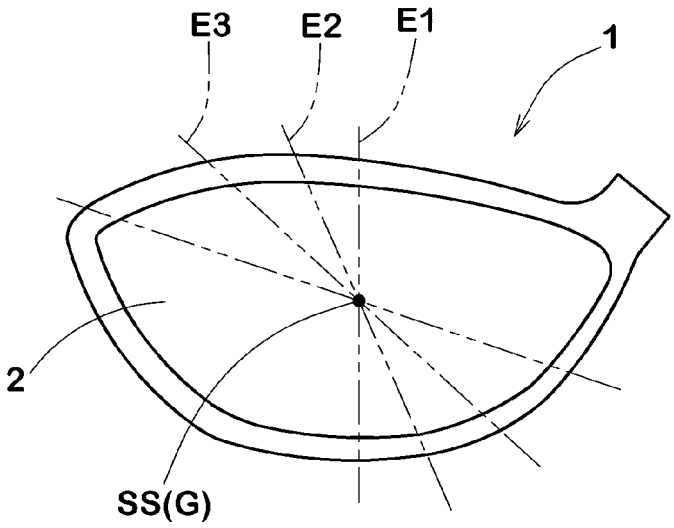
FIGS. 4(A) and 4(B) are a front view and a cross sectional view, respectively, of a club head for explaining the peripheral edge of the club face.
Figure 4B:
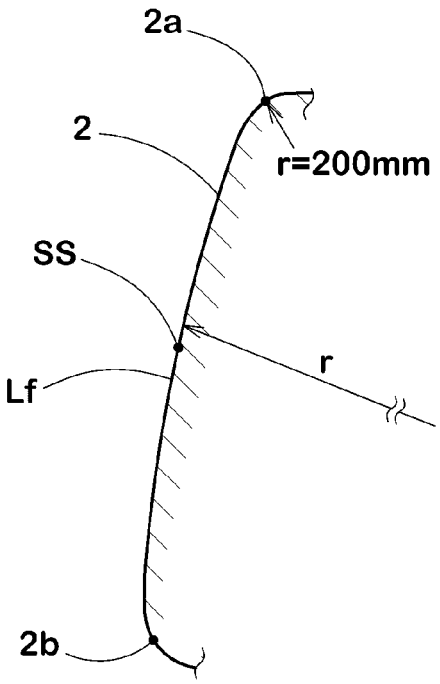

The club head 1 is, as shown in FIG. 3, provided with a hollow (i) therein and has a hollow structure.

The club head 1 in this embodiment has a head volume of not less than 100 cc and less than 350 cc. Typically, a club head having such head volume is for a fairway wood or a utility club. This kind of club head has many opportunities to hit a golf ball directly set on the ground rather than a golf ball teed up, therefore, it has many opportunities to hit a golf ball in a lower part of the club face.

According to the present invention, although the head volume of the club head 1 is limited, the club number and loft angle are not limited.

The club head 1 comprises a face portion 3, a crown portion 4, a sole portion 5, a side portion 6 and a hosel portion 7.

The front surface of the face portion 3 defines a club face 2 for hitting a golf ball. The club face 2 has a peripheral edge extending therearound and including an upper edge 2*a*, a lower edge 2*b*, a toe-side edge 2*c* and a heel-side edge 2*d*. The club face 2 may be provided with score lines and/or punch marks (not shown).

The crown portion 4 extends backwardly of the club head from the upper edge 2*a* of the club face 2 so as to form the top surface of the club head.

The sole portion 5 extends backwardly of the club head from the lower edge 2*b* of the club face 2 so as to form the bottom face of the club head.

The side portion 6 extends between the crown portion 4 and the sole portion 5 and extends from the toe-side edge 2*c* of the club face 2 to the heel-side edge 2*d* of the club face 2 through the back side of the club head.

The hosel portion 7 is formed in a heel-side of the club head 1. The hosel portion 7 is tubular and provided with a shaft inserting hole 7*a* into which a club shaft is inserted.

The club head 1 is composed of a face member 1 and a head main body 1B as shown in FIG. 3.

In this embodiment, each of the face member 1 and head main body 1B is made of a metal material. For example, stainless steel, maraging steel, titanium alloy and the like can be suitably used as such metal materials. However, the head main body 1B may be partly made of a fiber reinforced resin.

The face member 1A integrally includes the face portion 3 and a turnback 9 extending backwardly of the club head from the peripheral edge of the club face 2, therefore, the face member 1A is substantially cup-shaped and has an edge O1 of an opening toward the back side.

In this embodiment, the face member 1A includes the entirety of the club face 2. As another embodiment, the face member 1A may include only a part of the club face 2. In this case, it is preferable that the face member 1A includes a major part of the club face 2 inclusive of the sweet spot SS.

In this embodiment, the turnback 9 includes a crown-side turnback 9*a*, a sole-side turnback 9*b*, a toe-side turnback 9*c* and a heel-side turnback 9*d*. Thereby, the turnback 9 is formed substantially continuously around the face portion 3.

The crown-side turnback 9*a* extends backwardly of the club head from the upper edge 2*a* of the club face 2 so as to form a fore part of the crown portion 4.

The sole-side turnback 9*b* extends backwardly of the club head from the lower edge 2*b* of the club face 2 so as to form a fore part of the sole portion 5.

The toe-side turnback 9*c* extends backwardly of the club head from the toe-side edge 2*c* of the club face 2 so as to form a toe-side fore part of the side portion 6.

The heel-side turnback 9*d* extends backwardly of the club head from the heel-side edge 2*d* of the club face 2 so as to form a heel-side fore part of the side portion 6.

The head main body 1B forms the remaining part of the club head 1 excluding the face member 1A. The head main body 1B integrally includes a crown aft part 4*a*, a sole aft part 5*a*, a side aft part 6 and the hosel portion 7. The head main body 1B is also substantially cup-shaped and has an edge O2 of opening toward the front side. Preferably, the head main body 1B is formed as a single piece by casting.

The crown aft part 4*a* of the head main body 1B forms the aft part of the crown portion 4.

The edge of the crown aft part 4*a* is butted with the edge of the crown-side turnback 9*a* of the face member 1A.

The sole aft part 5*a* of the head main body 1B forms the aft part of the sole portion 5.

The edge of the sole aft part 5*a* is butted with the edge of the sole-side turnback 9*a* of the face member 1A.

The side aft part 6*a* of the head main body 1B forms the aft part of the side portion 6.

The edge of the side aft part 6*a* is butted with the edges of the toe-side and heel-side turnbacks 9*c* and 9*d* of the face member 1A.

The club head 1 is manufactured by connecting the face member 1 and the head main body 1B with each other. In this embodiment, they are connected by welding. The connecting method is however, not limited to welding. Various methods, e.g. brazing, soldering, adhesive agent, screw fastening and the like can be employed.

According to the present invention, the method for manufacturing the golf club head is characterized in the process of producing the face member 1A which comprises the following steps (a)-(d):

(a) preparing a flat-plate-like plate material, (b) cut out a flat-plate-like part for the face member from the flat-plate-like plate material, (c) providing the turnback 9 for the flat-plate-like part by press working thereon after the step (b), to form the face member, and (d) forming a groove on the flat-plate-like part or the flat-plate-like plate material prior to the step (c) so that the groove extends along a line corresponding to the boundary of the turnback with the face portion.

[Step (a)]

In the step (a), a flat-plate-like plate material for producing the face member 1A is prepared. As to the plate material, various sorts of metal materials can be used. Preferably, rolled materials are used. The plate material has a uniform thickness. Preferably, the plate material has a thickness equal to or more than the maximum thickness of the face member 1A.

[Step (b)]

Figure 5:
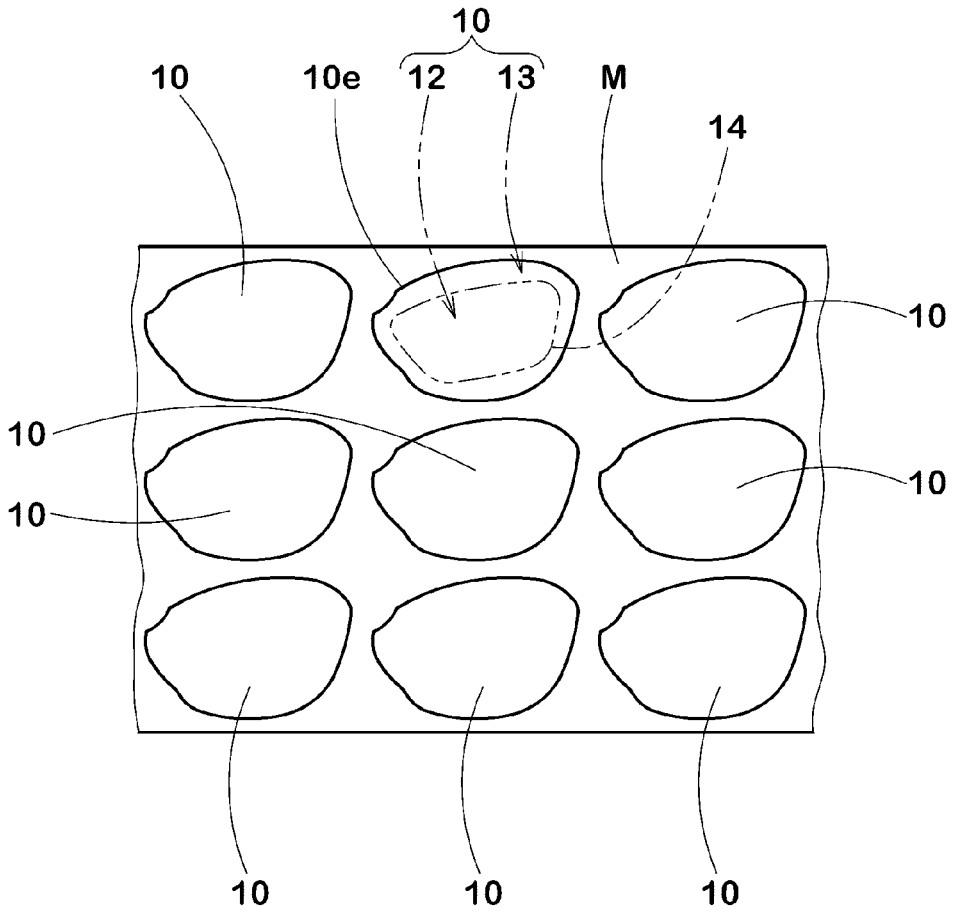
FIG. 5 is a diagram for explaining the cutting out of the flat-plate-like part for the face member from the plate material.

FIG. 5 shows an example of the plate material M.

In the step (b), a flat-plate-like part 10 for the face member is cut out from the plate material M. The step (b) is carried out after the step (a). Preferably, a plurality of parts 10 are cut out from the plate material M as shown in FIG. 5.

The part 10 has an edge 10*e* defining the contour. The edge 10*e* encompasses at least a region 12 corresponding to the face portion 3 and finally forming the face portion 3, and a region 13 corresponding to the turnback 9 and finally forming the turnback 9. It is possible to determine the edge 10*e* to further encompass a cutting stock and the like.

As to the method to cut out the part 10, a cutting method, for example, press cutting, laser cutting or the like can be employed.

[Step (d)]

The step (d) includes a step of forming a groove in the part 10 or alternatively in the plate material M so that the groove extends along the boundary 14 between the region 13 corresponding to the turnback and the region 12 corresponding to the face portion of the part 10 or the plate material M.

This step (d) is carried out after the step (a) of preparing the plate material M and prior to the undermentioned step (c) of press working. The step (d) can be carried out after or prior to the step (b). In this embodiment, the step (d) is carried out after the step (b), namely, carried out on the cut-out part 10.

Figure 6A:
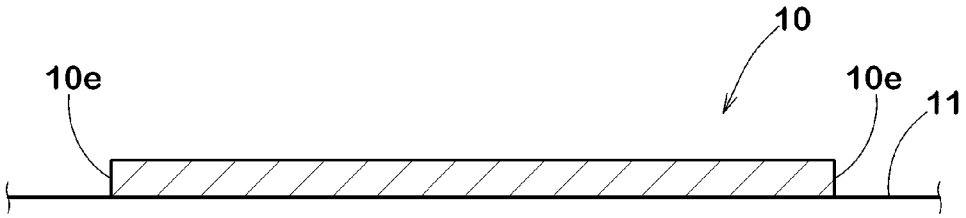
FIGS. 6(A)-6(C) are schematic cross sectional views of the flat-plate-like part for explaining the process of producing the face member.
Figure 6B:
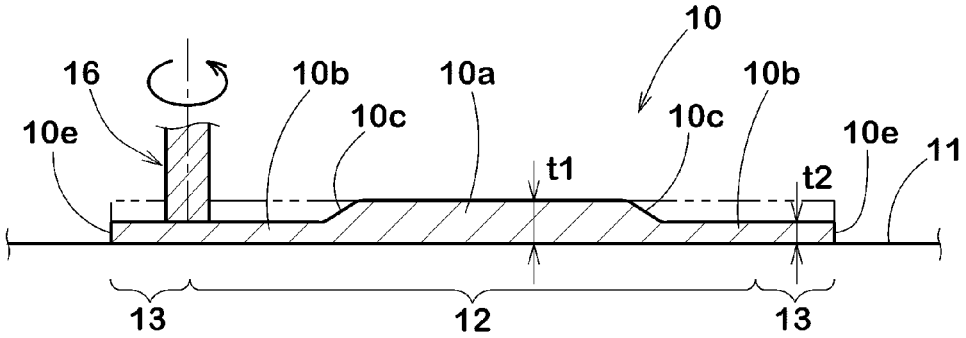
Figure 6C:
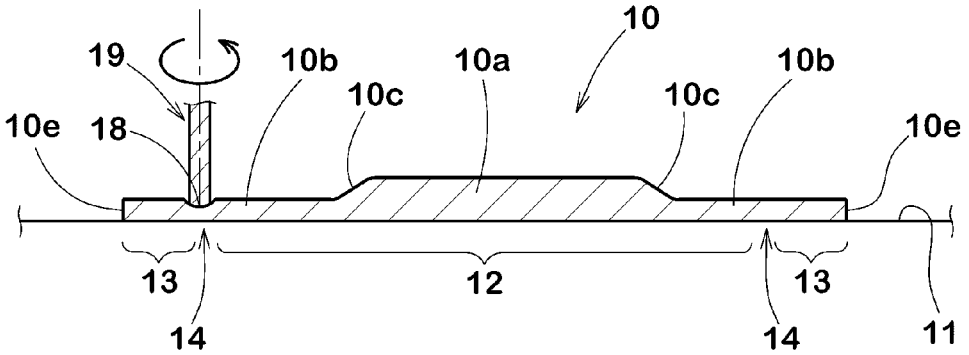

In order to explain the step (d), the cross sectional views of the part 10 are shown in FIGS. 6(A)-6(C).

FIG. 6(A) shows a state of the part 10 which is fixedly set on a working table 11 such that the upper side of the part 10 corresponds to the back side of the face member 1A, namely the back side of the face member 1A is in an upward direction.

FIG. 6(B) shows a thickness adjusting step optionally included in the step (d).

In this thickness adjusting step, the thickness of the part 10 is adjusted by cutting work. Thereby, the part 10 is provided with a first section 10*a* having a relatively large thickness t1, and a second section 10*b* having a relatively small thickness t2.

As the cutting work in this embodiment, surface grinding is carried out on the surface of the part 10 by the use of a cutting tool 16, e.g. end mill and the like.

Figure 7:
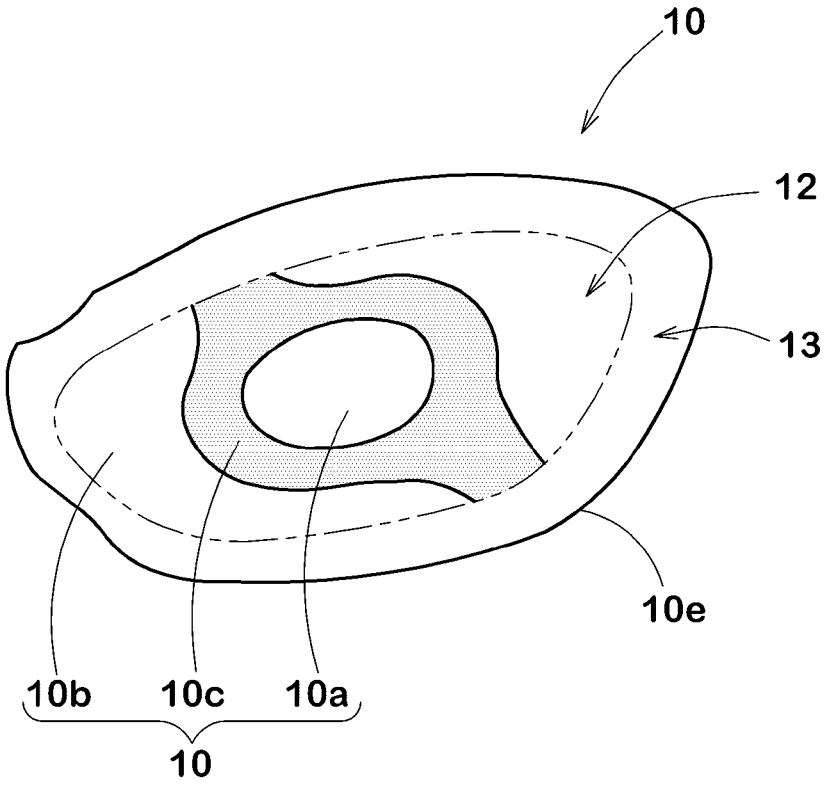
FIG. 7 is a rear view of the flat-plate-like part for the face member.

In FIG. 7, shown is a plan view of the part 10 obtained through the thickness adjusting step of the step (d).

The first section 10*a* is formed in a central part of the region 12 corresponding to the face portion. The first section 10*a* is formed not to protrude from the region 12 corresponding to the face portion.

The thickness t1 of the first section 10*a* is constant and equal to that of the plate material M since the cutting work is not carried out for the first section 10*a*.

The second section 10*b* is formed outside the first section 10*a* so as to surround the first section 10*a*.

In this embodiment, the second section 10*b* is formed so as to extend from the region 12 corresponding to the face portion into the region 13 corresponding to the turnback, and the second section 10*b* continues to the edge 10*e*.

The thickness t2 of the second section 10*b* is substantially constant.

Between the first section 10*a* and the second section 10*b*, there is provided with a transitional section 10*c* having a variable thickness decreasing gradually from the first section 10*a* towards the second section 10*b*.

In this example, on the crown-side and on the sole-side of the first section 10*a*, the transitional section 10*c* extends to the boundary 14.

Such transitional section 10*c* mitigates stress concentration occurring in the region 12 due to the thickness difference.

In this invention, the above-mentioned thickness adjusting step is optional, but preferably carried out.

FIG. 6(C) shows the main step of the step (d). In the main step, the part 10 is provided with a groove 18.

The groove 18 is formed so as to extend along the boundary 14 between the region 12 corresponding to the face portion and the region 13 corresponding to the turnback. The groove 18 is formed by surface grinding using a cutting tool 19, e.g. end mill and the like. However, the groove 18 may be formed by press working or the like.

Figure 8:
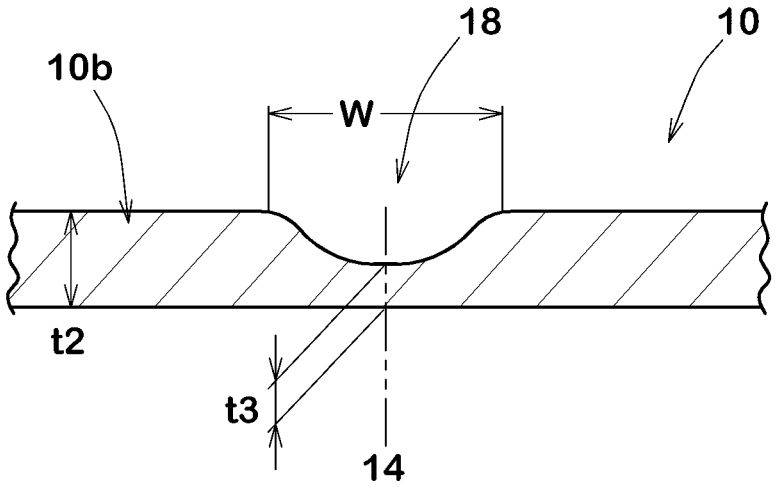
FIG. 8 is an enlarged cross sectional view of the grooved part of FIG. 6(C).

FIG. 8 shows the cross section of the groove 18.

As shown, the groove 18 is formed so that the boundary 14 is included within the groove width, and it is preferable that the depth of the groove 18 is smoothly increased to the widthwise center to have a smoothly curved contour like an arc. Accordingly, by the groove 18, the second section 10*b* is partially provided with a part having a relatively small thickness t3.

Figure 9:
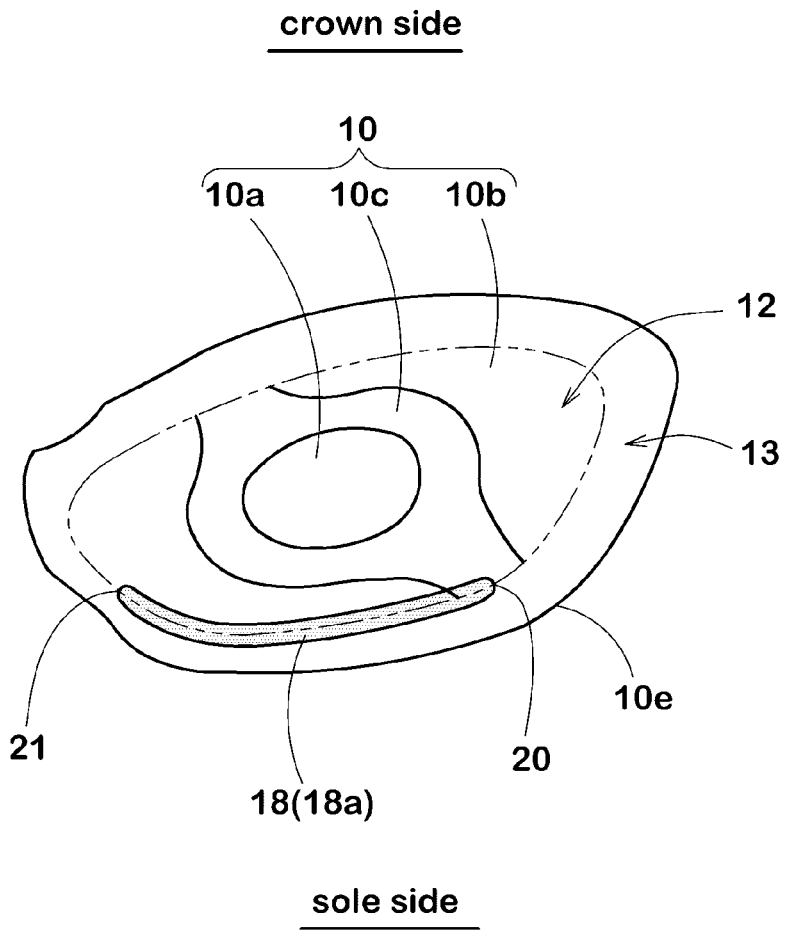
FIG. 9 is a rear view of the flat-plate-like part for the face member.

FIG. 9 shows a plan view of the part 10 obtained through the main step of the step (d).

In this embodiment, the groove 18 is formed as a sole-side groove 18*a* extending along a sole-side part of the boundary 14, and the groove 18 is not formed along a crown-side part, a toe-side part and a heel-side part of the boundary 14.

The sole-side groove 18*a* has a toe-side end 20 and a heel-side end 21, and the groove is curved like an arc between the ends 20 and 21.

The configuration of the groove 18 is not to be limited to the above-mentioned example.

For example, as another example of the groove 18, it may be extended continuously and circularly along the boundary 14.

[Step (c)]

Figure 10:
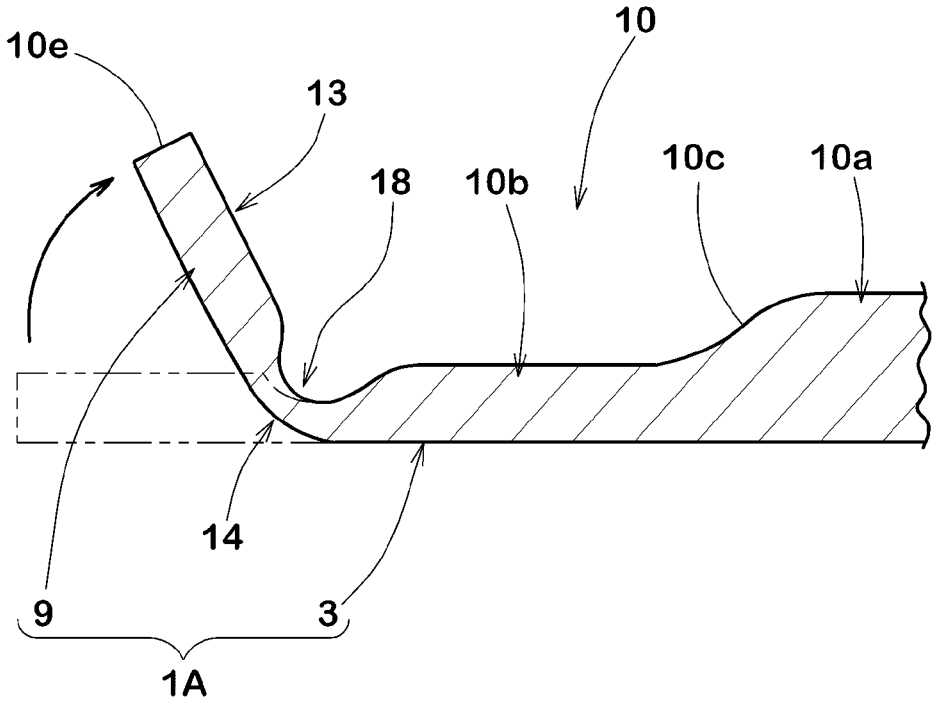
FIG. 10 is an enlarged cross sectional view of the grooved part of the flat-plate-like part for explaining the press working carried out on the flat-plate-like part for the face member.

FIG. 10 shown is a cross section of the grooved part of the part 10 for explaining the step (c).

In the step (c), press working is carried out on the part 10 to form the turnback 9 and thereby to form the face member 1A. Thus, the step (c) is to obtain the face member 1B by forming the turnback 9 on the part 10 through press working (drawing) carried out after the step (b).

The groove 18 provided with the part 10 is pressed by the use of press dies (not shown). The press dies include a male die and a female die as usual. The part 10 is set in the press dies and pressure is applied thereto.

Preferably, the press working is carried out a plurality of times, changing the pressure and/or the press dies.

During the press working, the region 13 corresponding to the turnback, of the part 10 outside the groove 18 is bent backwardly of the club head, and the turnback 9 is formed. Thereby, the face member 1A is produced from the part 10. The region 13 corresponding to the turnback can be easily bent backwardly as the bending deformation is facilitated by the relatively thin grooved part or groove 18.

Therefore, the turnback 9 can be easily formed even if it has a larger size toward the back side of the club head.

On the other hands, the groove 18 mitigates compressive strain occurring on the back side of the boundary 14, and the occurrence of surface defects, wrinkling and the like of the shaped part 10 can be effectively prevented.

For the accurate press working, the width W of the groove 18 is preferably not less than 1.0 mm, more preferably not less than 1.5 mm, still more preferably not less than 2.0 mm, but not more than 4.0 mm, more preferably not more than 3.5 mm, still more preferably not more than 3.0 mm.

Figure 11:
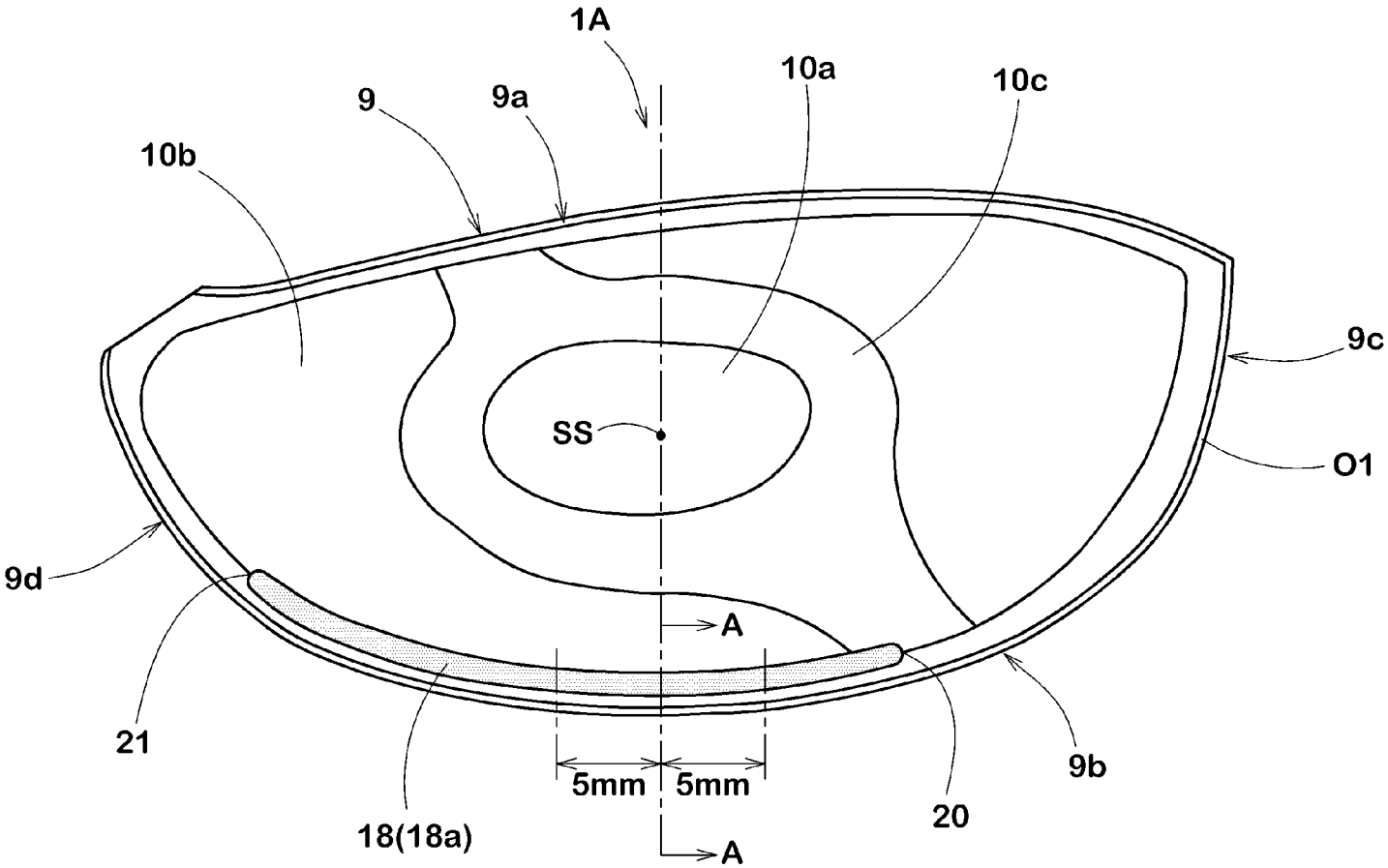
FIG. 11 is a rear view of the face member.
Figure 12:
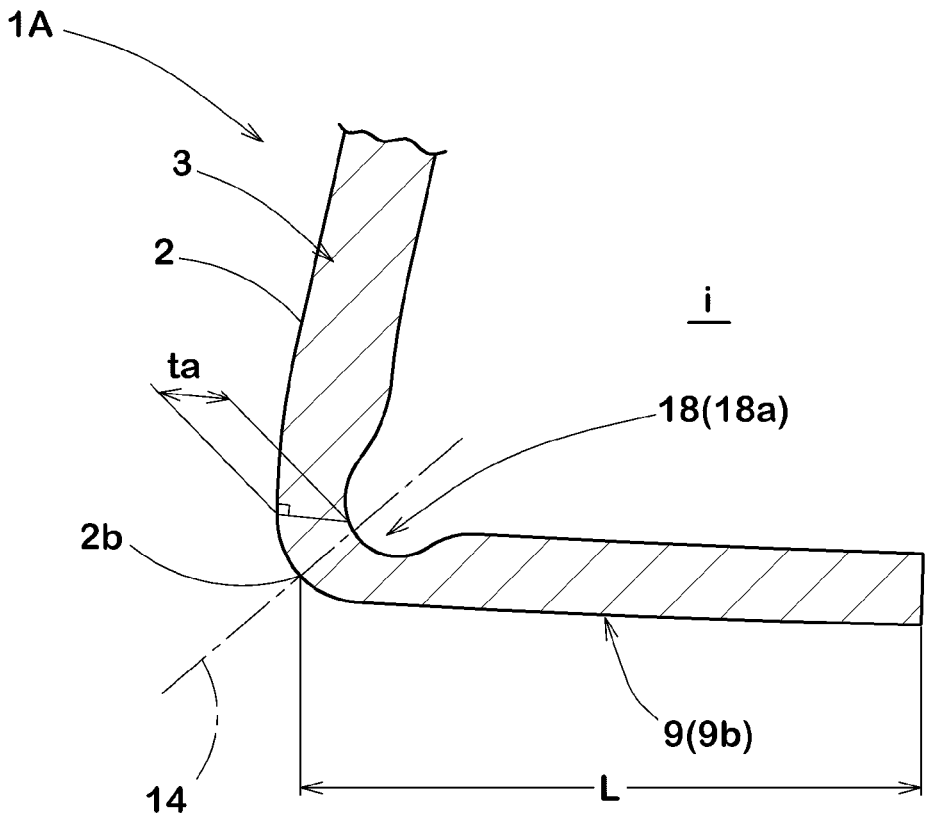
FIG. 12 is a cross sectional view taken along line A-A of FIG. 11.

FIG. 11 shows a rear view of the face member 1A manufactured by the method according to the present invention. FIG. 12 shows a cross sectional view taken along line A-A of FIG. 11.

As shown in FIG. 11 and FIG. 12, the inner surface on the hollow (i) side, of the face member 1A has the groove 18 extending along the boundary 14 between the face portion 3 and the turnback 9. In other words, the groove 18 is remained on the face member 1 after the press working or pressure molding has been done.

In the face member 1A, the boundary 14 can be approximately determined by the positions of normal lines to the club face 2 at the peripheral edge thereof.

Since the groove 18 provides the relatively small thickness for the peripheral edge of the club face 2, the groove 18 allows the face portion 3 to effectively deflect when hit by a golf ball and improves the rebound performance of the club head 1.

In the club head 1 as the target of the present invention, whose head volume is not less than 100 cc and less than 350 cc, there are many opportunities to hit a golf ball directly set on the ground rather than a golf ball teed up. Therefore, there is a tendency that a golf ball is hit by a lower part of the club face.

In the face member 1A in this embodiment, since the sole-side groove 18*a* is provided as explained above, even if the club head 1 is used by a golfer whose ball hitting positions concentrate in a sole side of the club face 2, the club head 1 can exert good rebound performance.

It is preferable that, as shown in FIG. 11, the sole-side groove 18*a* extends so as to range in the toe-heel direction at least 5 mm toward the toe and toward the heel from the sweet spot SS of the club face 2. Therefore, even if the ball hitting position is in a sole-side of the club face 2 and off center, the head 1 can certainly exert good rebound performance.

More preferably, the toe-side end 20 and the heel-side end 21 of the sole-side groove 18 are disposed outside the above-mentioned range of 10 mm (5+5) in the toe-heel direction.

In this embodiment, the groove 18 is the sole-side groove 18*a*, in other words, the groove 18 is not formed along other parts than the sole-side part of the boundary. Accordingly, the durability of the face portion 3 can be improved in a crown side, a toe side and a heel side of the face portion 3 where the groove 18 is not formed.

The thickness to of the face member at the sole-side groove 18*a* is preferably set in a range of not less than 0.5 mm, more preferably not less than 0.8 mm, still more preferably not less than 1.0 mm, but not more than to 2.0 mm, more preferably not more than 1.8 mm, still more preferably not more than 1.5 mm. As shown in FIG. 12, the thickness ta is a minimum thickness occurring within the width of the groove when measured at a right angle to the tangent to the outer surface of the face member.

If the thickness ta is less than 0.5 mm, there is a possibility that the durability of the face portion 3 decreases. If the thickness ta is more than 2.0 mm, there is a possibility that the rebound performance of the club head 1 decreases.

Comparison Tests

In order to confirm the effects of the present invention, fairway wood type golf club heads (head volume 180 cc, loft angle 15 degrees, lie angle 58 degrees) were manufactured, including heads Ex. 1-Ex. 9 according to the present invention and a comparative example Ref. 1.

[Club Heads Ex. 1-Ex. 9 According to the Present Invention]

In each example, as shown in FIGS. 1 to 12, the face member was produced through the steps (a), (b), (c) and (d, including the optional thickness adjusting step), and the groove 18 was formed along a sole-side part and a heel-side part of the boundary of the face portion with the turnback.

[Club Head Ref. 1 as a Comparative Example]

The face member was produced through the steps (a), (b) and (c) and the thickness adjusting step as explained above. Therefore, the groove 18 was not formed.

Aside from the groove 18, all of the club heads were identical.

specifications common to all of the club heads are as follows:

face member material: stainless CUSTOM455
head main body material: stainless CUSTOM450
thickness t1 of plate material or first section: 2.5 mm
thickness t2 of second section: 2.2 mm
maximum size of crown-side turnback: 5.0 mm
maximum size of sole-side turnback: 8.0 mm
maximum size of toe-side turnback: 8.0 mm
maximum size of heel-side turnback: 8.0 mm The club heads were tested for the production efficiency, and the rebound performance and durability as follows.

[Production Efficiency]

For each face member, thirty pieces were produced by the press working and they were visually checked for the finished status of the turnback, and defects, wrinkling and the like at the boundary between the face portion and the turnback.

The results are indicated in Table 1 by an index based on the defect rate of the comparative example (Ref. 1) being 100, wherein the smaller value is better.

[Rebound Performance Test]

According to the "Procedure for Measuring the velocity Ratio of a club Head for Conformance to Rule 4-1e, Appendix II, Revision 2 (Feb. 8, 1999), united states Golf Association.", the restitution coefficient was obtained.

The results are indicated in Table 1 by an index based on the comparative example (Ref. 1) being 100, wherein the larger value is better.

[Durability Test]

Each head was attached to an identical shaft, and the golf club was mounted on a swing robot. Then, the head hit golf balls at a head speed of 49 meter/second, while checking the face plate. The ball hitting position was 5 mm toward the sole from the sweet spot of the club face. If damage or breakage was found, the test was stopped and the number of hits was recorded. The results are indicated in Table 1 by an index based on the comparative example (Ref. 1) being 100, wherein the larger value is better.

TABLE 1

| Head | Ref. 1 | Ex. 1 | Ex. 2 | Ex. 3 | Ex. 4 |
|---|---|---|---|---|---|
| groove sole-side part | none | | | | |
| width (mm) before press working | — | 2.5 | 1.0 | 4.0 | 2.5 |
| depth (mm) before press working | — | 0.9 | 0.9 | 0.9 | 1.7 |
| thickness ta(mm) after press working | — | 1.3 | 1.3 | 1.3 | 0.5 |
| Production efficiency | 100 | 70 | 80 | 65 | 60 |
| Rebound performance | 100 | 120 | 115 | 125 | 140 |
| Durability | 100 | 90 | 95 | 85 | 75 |
| **Head** | **Ex. 5** | **Ex. 6** | **Ex. 7** | **Ex. 8** | **Ex. 9** |
| groove sole-side part | | | | | |
| width (mm) before press working | 2.5 | 0.5 | 4.5 | 2.5 | 2.5 |
| depth (mm) before press working | 0.2 | 0.9 | 0.9 | 1.8 | 0.1 |
| thickness ta(mm) after press working | 2.0 | 1.3 | 1.3 | 0.4 | 2.1 |
| Production efficiency | 80 | 95 | 60 | 110 | 95 |
| Rebound performance | 110 | 105 | 130 | 150 | 105 |
| Durability | 100 | 95 | 50 | 65 | 100 |

From the test results, it was confirmed that the production efficiency of the face member according to the manufacturing method of the present invention, can be improved, and that the club head manufactured according to the manufacturing method of the present invention has high rebound performance while maintaining the durability.

While description has been made of preferable embodiments of the present invention, the illustrated embodiments should not be construed as to limit the scope of the present invention; various modifications are possible without departing from the scope of the present invention.

The invention claimed is:

1. A golf club head having a hollow therein and a head volume of not less than 100 cc and less than 350 cc, and comprising a head main body and a substantially cup-shaped face member which are united with each other, wherein the face member integrally includes a face portion having a club face for hitting a ball, and a turnback extending backwardly of the head from a peripheral edge of the club face, an inner surface on the hollow side, of the face member is provided with a groove extending along the boundary of the turnback with the face portion, the face member is a press-formed part whose turnback is bent by press working, said groove is a sole-side groove extending along only a sole-side part of the boundary, and the sole-side groove extends in the toe-heel direction of the head by at least 5 mm toward the toe and toward the heel of the head from a position in the toe-heel direction corresponding to that of a sweet spot of the club face.

2. The golf club head according to claim 1, wherein the face portion is provided with a first section formed in a central part of the face portion and having a constant thickness, a second section formed outside the first section and having a constant thickness smaller than that of the first section, and a transitional section extending annularly around the first section and having a variable thickness decreasing gradually from the first section towards the second section, on the crown-side of the first section, the transitional section extends to said boundary so that the intersection therebetween is positioned on the heel side of the sweet spot, on the sole-side of the first section, the transitional section extends to said boundary so that the intersection therebetween is positioned on the toe side of the sweet spot, the part of the face portion on the toe side of the transitional section and the part of the face portion on the heel side of the transitional section constitute said second section, and said sole-side groove has a toe-side end positioned within the extent of said intersection on the sole-side of the first section.

3. The golf club head according to claim 2, wherein the sole-side groove extends in the toe-heel direction of the head by at least 5 mm toward the toe and toward the heel of the head from the sweet spot of the club face, and the distance in the toe-heel direction between the sweet spot and the heel-side end of the club face is larger than the distance in the toe-heel direction between the sweet spot and the toe-side end of the club face.

4. The golf club head according to claim 1, wherein the sole-side groove extends in the toe-heel direction of the head by at least 5 mm toward the toe and toward the heel of the head from the sweet spot of the club face, and the sole-side groove has a heel-side end and a toe-side end such that the distance in the toe-heel direction between the sweet spot and the heel-side end of the sole-side groove is larger than the distance in the toe-heel direction between the sweet spot and the toe-side end of the sole-side groove.

5. A golf club head having a hollow therein and a head volume of not less than 100 cc and less than 350 cc, and comprising a head main body and a substantially cup-shaped face member which are united with each other, wherein the face member integrally includes a face portion having a club face for hitting a ball, and a turnback extending backwardly of the head from a peripheral edge of the club face, an inner surface on the hollow side, of the face member is provided with a groove extending along the boundary of the turnback with the face portion, the face member is a press-formed part whose turnback is bent by press working, and the thickness of the face member measured at the groove is 0.5 to 2.0 mm.

* * * * *